US010589436B1

(12) United States Patent
Panosian et al.

(10) Patent No.: US 10,589,436 B1
(45) Date of Patent: Mar. 17, 2020

(54) SINGLE-ACTION CONVERTIBLE UTILITY KNIFE AND SCRAPPER

(71) Applicant: TOUGHBUILT INDUSTRIES, INC., Lake Forest, CA (US)

(72) Inventors: Michael H. Panosian, Irvine, CA (US); Joshua Keeler, Lake Forest, CA (US)

(73) Assignee: TOUGHBUILT INDUSTRIES, INC., Lake Forest, CA (US)

( * ) Notice: Subject to any disclaimer, the term of this patent is extended or adjusted under 35 U.S.C. 154(b) by 0 days.

(21) Appl. No.: 16/506,186

(22) Filed: Jul. 9, 2019

(51) Int. Cl.
*B26B 11/00* (2006.01)
*B26B 5/00* (2006.01)
*B26B 1/08* (2006.01)

(52) U.S. Cl.
CPC ..... *B26B 11/006* (2013.01); *B26B 1/08* (2013.01); *B26B 5/003* (2013.01)

(58) Field of Classification Search
CPC ..... B26B 1/08; B26B 5/003; B26B 5/005; B26B 5/006; B26B 11/006
USPC ..... 30/154, 162, 2, 169, 320, 321
See application file for complete search history.

(56) References Cited

U.S. PATENT DOCUMENTS 1,079,300 A * 11/1913 Littleton, Jr. et al. ..... A41H 25/02 30/154
2,071,562 A * 2/1937 Nelson ..... B44D 3/162 30/154
2,094,260 A * 9/1937 Brody ..... B26B 5/006 30/162
2,107,736 A * 2/1938 Huber ..... B26B 5/006 30/162
2,133,087 A * 10/1938 Ericsson ..... B44D 3/162 30/339
2,164,050 A * 6/1939 Brown ..... B26B 5/006 30/151
2,242,900 A * 5/1941 Bender ..... B26B 5/006 30/154
2,257,314 A * 9/1941 Shinn, Jr. ..... A47L 13/08 30/320
2,650,422 A * 9/1953 Soltow et al. ..... B26B 5/00 30/154
2,662,284 A * 12/1953 Unsinger ..... B26B 1/08 30/162
2,870,537 A * 1/1959 Ortner ..... B26B 5/001 30/162

(Continued)

*Primary Examiner* — Jason Daniel Prone
(74) *Attorney, Agent, or Firm* — Myron Greenspan; Lackenbach Siegel LLP

(57) ABSTRACT

A single-action convertible utility knife and scraper includes a carriage and a slide mechanism slidably mounted within a housing. A blade support is pivotally mounted on the carriage for movements of a blade between cutting and scraper orientations. The carriage and the slide mechanism can be moved by an external button between a retracted position wherein the blade support is fully retracted within the housing, an extended position wherein the blade support is in an operative cutting or scraping position and a conversion position wherein the blade support is moved forwardly of the extended position to enable the blade support to transition from one orientation to another while clearing the housing. A bi-stable mechanism alternatingly pivots the blade support between the first and second orientations when the external button is successively advanced to move the slide mechanism forwardly beyond the extended position to incrementally advanced positions.

14 Claims, 11 Drawing Sheets

(56) References Cited

U.S. PATENT DOCUMENTS 3,176,395 A * 4/1965 Warner et al. ..... B26B 1/02 30/154
3,518,758 A * 7/1970 Bennett ..... B26B 5/005 30/154
3,667,122 A * 6/1972 Black ..... B26B 29/02 30/286
4,100,677 A * 7/1978 Jeff ..... B26B 5/00 30/321
4,617,736 A * 10/1986 McCrary ..... B44D 3/162 30/169
4,955,138 A 9/1990 Henke et al.
5,440,811 A * 8/1995 Challis ..... B25G 3/26 30/169
6,000,137 A * 12/1999 Gamba ..... B26B 1/08 30/169
6,484,404 B1 * 11/2002 Kao ..... B26B 5/002 30/162
6,598,301 B2 7/2003 McCool et al.
6,785,966 B2 * 9/2004 Berns ..... B26B 5/003 30/2
6,951,055 B1 10/2005 Collins
7,185,435 B1 * 3/2007 Tseng ..... B26B 5/001 30/162
7,316,070 B2 * 1/2008 Green ..... B26B 5/001 30/162
7,322,110 B2 * 1/2008 Hernandez ..... B26B 5/001 30/162
7,647,702 B2 1/2010 Polei
7,765,701 B2 * 8/2010 Okada ..... B26B 5/003 30/162
7,797,835 B2 * 9/2010 Zeng ..... B26B 5/001 30/162
8,307,556 B2 * 11/2012 Davis ..... B26B 5/003 30/162
8,353,109 B2 * 1/2013 Rohrbach ..... B26B 5/003 30/162
8,689,450 B2 * 4/2014 Constantine ..... B26B 1/08 30/162
8,707,566 B2 * 4/2014 Rohrbach ..... B26B 5/003 30/154
8,732,957 B2 * 5/2014 Rohrbach ..... B26B 5/003 30/154
8,739,414 B2 * 6/2014 Tyers ..... B25F 1/00 30/162
8,931,180 B2 * 1/2015 Davis ..... B26B 5/003 30/162
D750,463 S * 3/2016 Sonne ..... D8/107
2009/0106983 A1 * 4/2009 Berns ..... B26B 5/003 30/162
2012/0304472 A1 * 12/2012 Medhurst ..... B26B 1/04 30/162
2016/0158945 A1 * 6/2016 Herlitz ..... B26B 5/003 30/162
2016/0167239 A1 * 6/2016 Gallegos ..... B26B 5/001 30/162

* cited by examiner

SINGLE-ACTION CONVERTIBLE UTILITY KNIFE AND SCRAPPER

BACKGROUND OF THE INVENTION

1. Field of the Invention

The invention generally relates to the field of hand tools and, more specifically, to a single-action convertible utility knife and scraper.

2. Description of the Prior Art

Utility knives typically have a blade cutting edge that is parallel to the handle or the housing axis and is used for cutting. Scrapers, on the other hand, typically have a blade that is perpendicular or normal to the axis of the handle and used for scraping surfaces, such as scraping paint off of windows or other materials from flat surfaces. Usually, utility knives and scrapers are two separate hand tools. This normally requires the purchase and storage of two separate tools.

A utility knife with a moveable and rotatable blade has been proposed in U.S. Pat. No. 3,518,758, in which the blade is moveable from a position within the knife handle to one with an exposed cutting edge. The blade can also be rotated to a scraping position. However, this tool requires a two hand operation in which a knob needs to be rotated with one hand to loosen the blade while the housing or handle of the tool is held with the other hand. Additionally, because the blade is manually rotated, it required the touching or handling of the blade, potentially causing injury to a user.

A similar multi-purpose utility tool is disclosed in U.S. Pat. No. 8,739,414 that includes an elongated body member configured to slidably house a tool bit mounting device inside the body member. The tool can support a utility blade that can also be moved to different orientations such as a utility blade position or a scraper-ripper position. However, this also requires a two hand operation necessitating the turning of a knurled knob in close proximity to the blade, potentially exposing the user to injury when rotating the blade from one position to another.

SUMMARY OF THE INVENTION

Accordingly, it is an object of the invention to provide a single-action convertible utility knife and scraper that does not have the disadvantages of prior art tools.

It is another object of the invention to provide a single-action convertible utility knife and scraper that is simple in construction and economical to manufacture.

It is still another object of the invention to provide a single-action convertible utility knife and scraper that is convenient and easy to use.

It is yet another object of the invention to provide a single-action convertible utility knife and scraper that can quickly convert the tool from one function to the other by use of a single hand.

It is a further object of the invention to provide a convertible utility knife and scraper as in the previous objects that is single-action and can effect conversions from one tool to the other tool by movement of an actuator button remote from the cutting edge of the blade.

It is still a further object of the invention to provide a convertible utility knife and scraper that can be used without exposing the user to injury from handling a blade or necessitating a hand of user to be in close proximity to the blade.

It is yet a further object of the invention to provide a convertible utility knife and scraper of the type under discussion that does not require manual tightening of a knob or other pressure applying member to a blade, thereby avoiding failure during use if the knob is inadvertently loosened or not sufficiently tightened by the user.

In order to achieve the above objects and others that will become evident from the description that follows, a presently preferred embodiment of the present invention is a single-action convertible tool that comprises an elongate housing having a front end and rear end and an elongate internal channel defining a longitudinal axis and having an opening at said front end and an elongate opening in a side wall of said elongate housing in communication with said channel and extending along a direction substantially parallel to said axis. A carriage is slidably mounted for movement along said axis within said internal channel between fully retracted and fully extended positions, said carriage including a first element of a bi-stable structure. A slide mechanism within said channel is coupled to said carriage for sharing movements with said carriage between said fully extended and retracted positions and being movable to a conversion position beyond said fully extended position relative to said carriage, said slide mechanism further including a second element of said bi-stable structure. A blade support assembly is provided for securing a blade, said blade support assembly being pivotally mounted on said carriage for movements between two generally orthogonal orientations, a first cutting orientation and a second scraping orientation. An actuator button is accessible exteriorly of said housing and coupled to said slide mechanism through said elongate opening for sliding said carriage and said slide mechanism between said fully extended and retraced positions and for moving said slide mechanism to said conversion position. Said bi-stable structure is arranged to alternatingly pivot said blade support assembly and any blade mounted thereon between said two orthogonal orientations when said actuator button is successively advanced forwardly to move said slide mechanism from said fully extended to said conversion positions.

DESCRIPTION OF PREFERRED EMBODIMENTS

Figure 1:
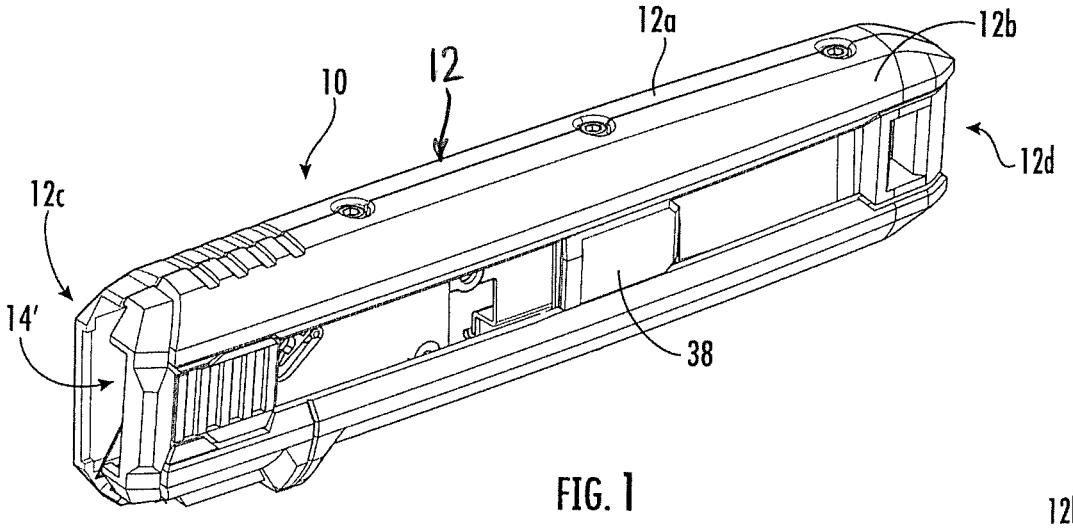
FIG. 1 is a perspective view of a single-action convertible utility knife and scraper in accordance with the invention, shown with the blade fully retracted.

Referring now specifically to the figures, in which identical or similar parts are designated by the same reference numerals throughout, and first referring to FIG. 1, the single-action convertible utility knife and scraper tool is generally designated by the reference numeral 10.

Figure 2:
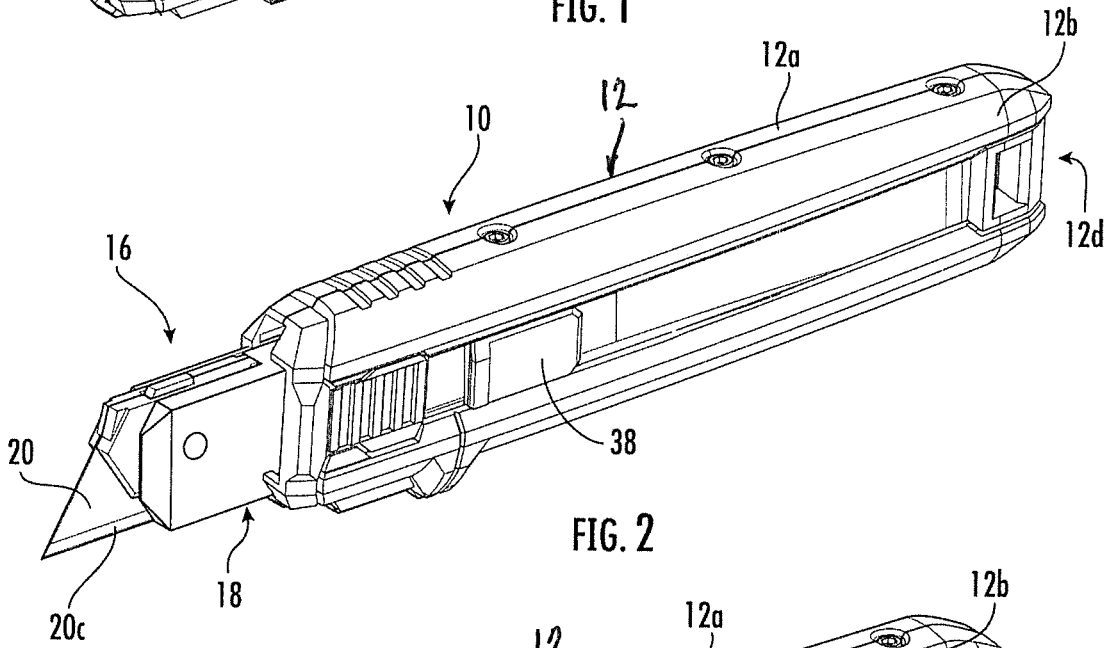
FIG. 2 is similar to FIG. 1 but showing the blade in an operative extended position to implement the tool to be used as a utility knife.
Figure 3:
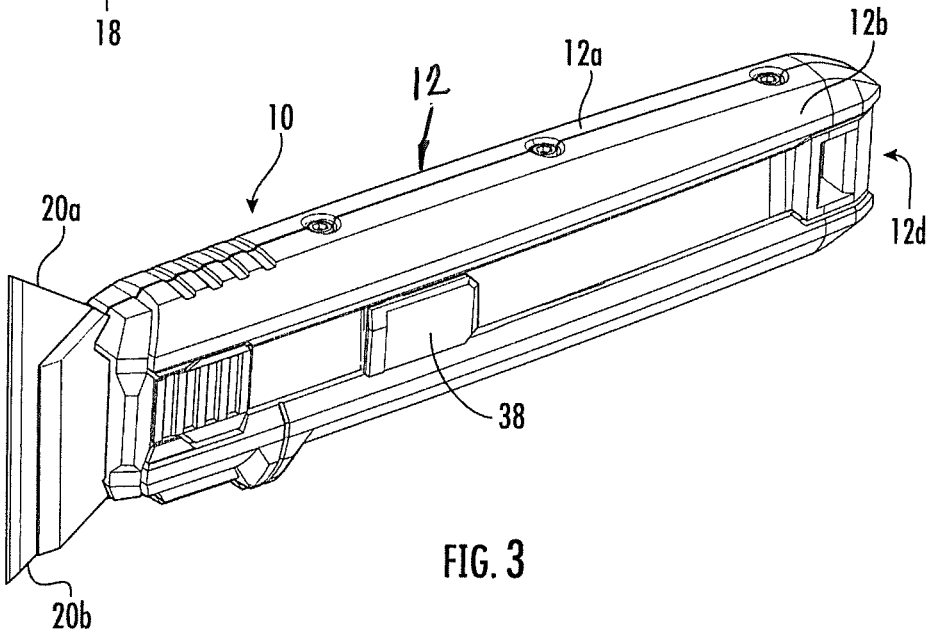
FIG. 3 is similar to FIG. 2 but is showing the blade in an operative scraper position.

The tool 10 includes an elongate housing 12 defining a longitudinal axis and suitable to serve as a handle or hand grip that can be formed of two clamshells 12*a*, 12*b* as is typical for such tools. The housing or handle 12 has a front end 12*c* and a rear end 12*d*. When the clamshells are assembled, as shown, they form an elongate internal channel 14 defining having an axis 12' and having an opening 14' at the front end 12*c*. As will be more fully described the tool 10 has an internal blade that is shown in a retracted position in FIG. 1. However, the tool can be quickly placed into a utility knife mode as shown in FIG. 2 or to a scraper mode as shown in FIG. 3 without touching or handling the blade.

Figure 4:
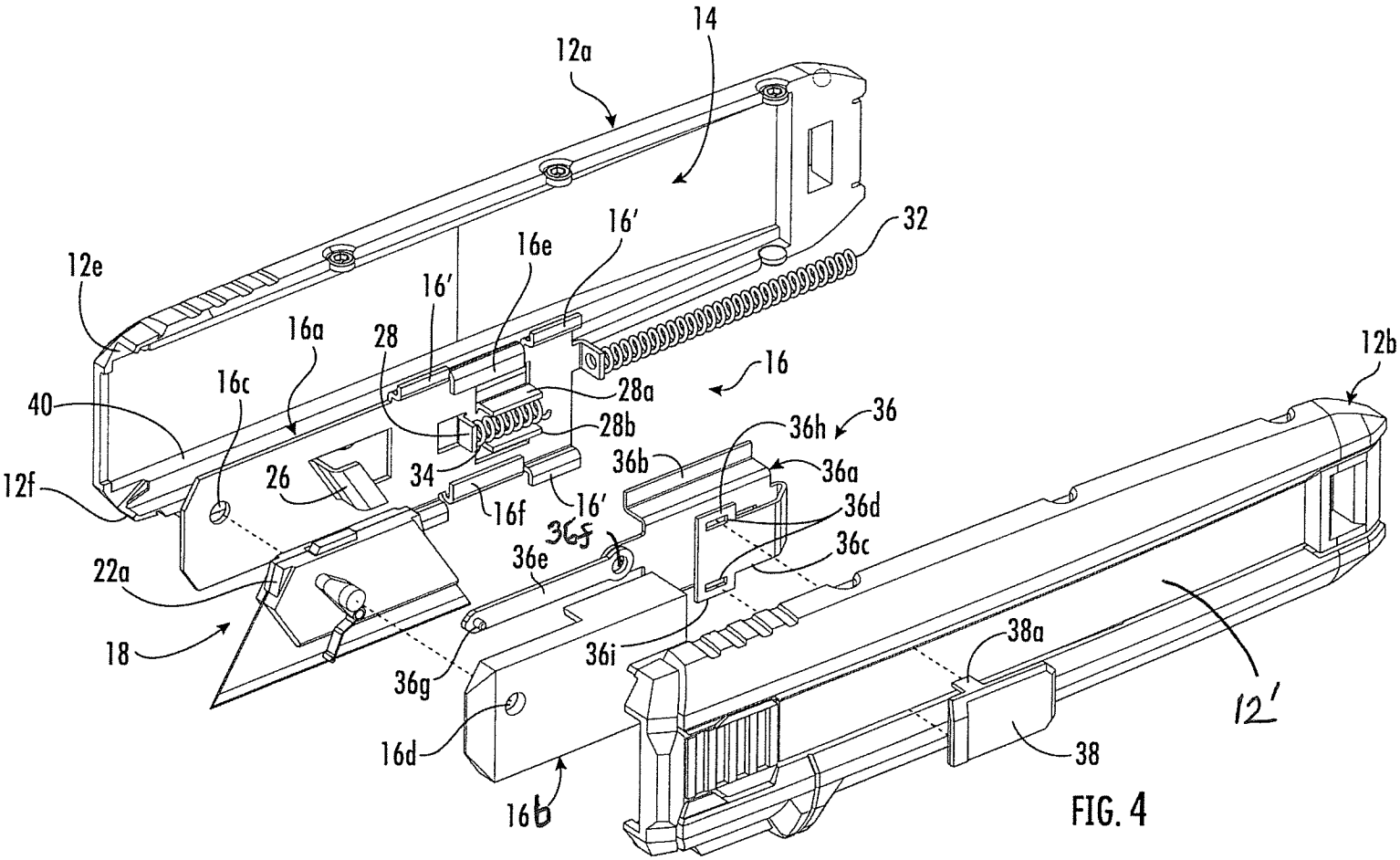
FIG. 4 is an exploded view of the utility knife shown in FIG. 1, showing the operative components thereof.

Referring to FIG. 4, a carriage is 16 slidably mounted for movement along the axis 12' along the internal channel 14 to multiple positions, as will be described. The carriage 16 includes a back plate 16*a* and a mating carriage member 16*b* that is fixed to the backplate 16*a* to share longitudinal or axial movements with those of the backplate. The mating carriage member 16*b* that may be formed of cast aluminum. The backplate 16*a* is provided with tabs or other guide members 16' to slidably mount the carriage 16 along a track 40 inside the shell 12*a* as shown.

Aligned holes 16*c*, 16*d* are provided at the front or leading ends of the backplate 16*a* and the mating carriage member 16*b*. Inwardly directed tabs 16*e*, 16*f* are provided to form guides for rails 36*b* of a sliding mechanism 36 to be described. An inclined cutout tab 26 is provided on the back plate 16*a* to serve as a stop to provide a bearing surface for a blade support assembly 18 to be described. Longitudinal tabs 28, 28*a* and 28*b* are provided for retaining a compression spring 34 as shown, to allow the compression spring to be compressed in response to an external force applied in the forward direction, towards the front end 12*c*, when the backplate 16*a* is at its forwardmost or conversion position. A tension spring 32 is secured to the backplate 16*a* in any suitable manner at one end while the other end of the spring is secured to a portion proximate to the rear end 12*d* of the housing 12. The tension spring 32 is a biasing member for normally urging the carriage 16 towards the rear end 12*d* of the housing. The carriage 16 can be manually urged to move towards the front end 12*c* against the tension applied by the spring 32.

A blade support assembly 18 is used to support a blade 20. The blade 20 may be a conventional utility blade having inclined edges 20*a*, 20*b* and a cutting edge 20*c*. The blade support assembly 18 has a front edge 18*a* angled to substantially maximize the exposure of the front side or edge 20*a* of the blade and the length of the cutting edge 20*c* and a rear edge 18*b* as shown. The blade support assembly 18 has a protuberance 22*a* above the blade at the front end, as shown in FIG. 4, and a similar protuberance 22*b* at the trailing end. Also referring to FIGS. 4A and 4B, projecting transversely from one surface of the blade support assembly 18 is a generally elongate portion serving as an actuating lever 18*c* defining opposing cam portions 18*d*, 18*e* that have cam surfaces 18*d'* and 18*e'*, respectively. There is provided a circular or cylindrical projection 18*f* between the cam surfaces 18*d'*, 18*e'* intended to be rotatably supported within the aperture or holes 16*d*. A similar projection is provided on the other side of the blade support assembly (not shown) that is rotatably received within aperture or hole 16*c* in the backplate 16*a* to thereby rotatably support the blade support assembly 18 on the carriage 16. Extending from the free end of the actuator lever portion 18*c* is a circular projection 18*g* to which there is pivotably coupled an over-dead center (ODC) spring 24, one end of which is pivotally secured to the actuator lever 18*c* while the other or free end is arranged to engage a surface within the mating carriage member 16*b*, as to be described.

The blade support assembly 18 secures a blade and is pivotably mounted on the carriage 16 for rotatable and linear movements with the carriage between a plurality of axial positions and two orthogonal orientations including a first orientation shown in FIG. 2 wherein the cutting edge of the blade is generally parallel to the axis 12' of the tool and a secondary orientation shown in FIG. 3 wherein the cutting edge of the blade is generally normal or perpendicular to the axis.

A slide mechanism 36 is provided that is coupled to the carriage 16 for sharing movements with the carriage including the retracted, extended, conversion and other intermediate positions of the carriage. The slide mechanism includes a body 36*a* formed with upwardly and downwardly directed rails 36*b* and a projecting spring finger 36*c* provided with at least one, but preferably two spaced slots 36*d* as shown. The rails 36*b* are configured to be slideably received within the tabs 16*e*, 16*f* on the backplate 16*a*. An elongate arm 36*e* is pivotally mounted at one end to the body 36*a* so that the arm can articulate in relation to the body 36*a* and can rotate in clockwise or counter-clockwise directions in relation to the generally axial orientation shown in FIG. 4. A pin 36*f* within a hole or aperture in the arm is used to enable the articulated motions. At the forward or free end of the arm 36*e* there is provided a pin or track follower 36*g* that extends laterally in the direction of the mating carriage member 16*b* and serves as one element of a bi-stable structure.

An actuator button 38 is accessible exteriorly of the housing 12 and coupled to the slide mechanism 36 through an elongate opening 12' for sliding the carriage 16 and the slide mechanism 36 between multiple positions along the channel 14 including, in the presently preferred embodiment, at least a retracted position when the blade support assembly 18 is totally retracted within the housing, an extended position wherein the blade support assembly is in an operative cutting or scraper position and a conversion position wherein the blade support assembly is moved to a forwardmost position of the carriage 16 to enable the blade support assembly to freely transition from one orientation to another while clearing the housing. The actuator button 38 engages the slide mechanism 36 by means of tabs 38*a* that are received within the slots 36*d*.

Turned in tabs 16*e*, 16*f* serve as guides for outwardly extending rails 36*b* so that the slide mechanism 36 can be moved forwardly along the axis relative to a stationary carriage 16 when sufficient forward pressure is applied to the actuator button 38 to overcome the spring restoring force of the compression spring 34 once the carriage 16 has reached its maximum forward or conversion position. The carriage 16 can be manually moved, in the presently preferred embodiment, between at least a retracted position, an extended position and a conversion position beyond the extended position of the blade support assembly. While presently preferred embodiment provides for the carriage and blade support assembly to be moved to a fully retracted position as shown in FIG. 1, the invention also contemplates elimination of the retracted position so that the blade assembly can only be placed in the extended or operative and the conversion positions so that the blade 20 always remains exposed.

Once the blade support assembly reaches its conversion position the carriage 16 can no longer move forward. However, the slide mechanism 36 can be moved incrementally forward along the axis relative to the carriage 16 against the action of the compression spring 34 when sufficient force is applied to the actuator button 38 and the compression spring 34 is compressed. This moves the slide mechanism 36 and the arm 36*e*, supporting the pin or surface track follower 36*g*, for reasons to be more fully described. When the actuator button is released in the conversion position of the blade support assembly the spring 34 causes the pin 36*g* to move incrementally rearwardly for reasons to be described.

Figure 5:
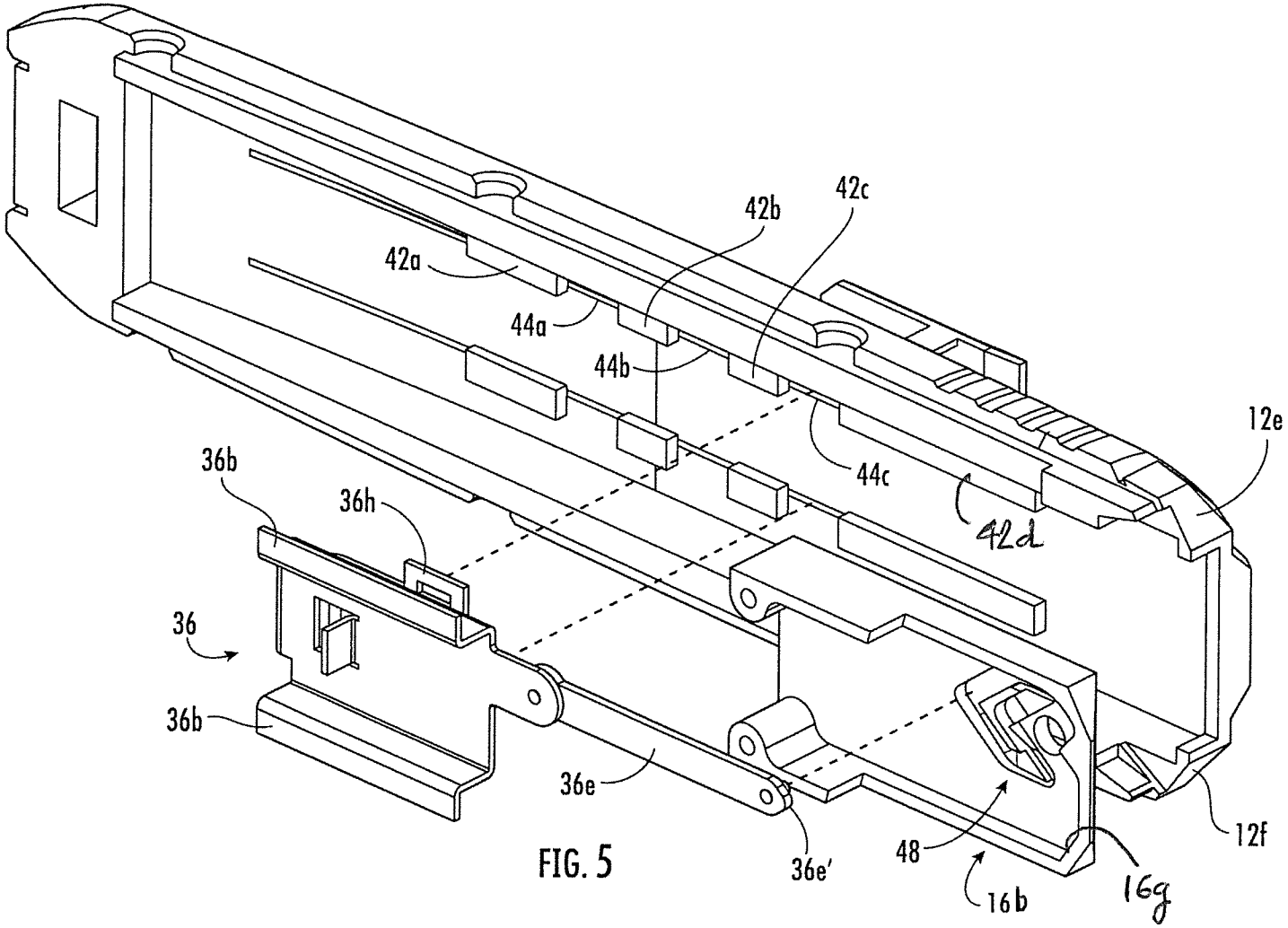
FIG. 5 is an enlarged perspective view of a portion or one clamshell of the housing on which the actuation button is mounted showing additional internal details, the carriage assembly and the slide mechanism coupled to the actuator button.

Referring to FIG. 5, the inside of the clamshell 12*b* is shown together with the reverse side of the mating carriage member 16*b* that additionally shows a tab 36*i* dimensioned to be received between tabs 28*a*, 28*b* to engage the spring 34. The inside surface of the clamshell 12*b* is formed with a plurality of upper and lower aligned segments or strips 42*a*-42*d* spaced longitudinally or axially as shown to provide aligned gaps or locking recesses 44*a*-44*c* to receive the projections 36*h* and 36*i* on the slide mechanism 36. It will be appreciated that only one set of strips, on the top or the bottom can be used although it is preferred to provide two opposing sets of strips for positively or reliably locking the carriage 16 in a desired position. The gap or recess 44*a* is used to lock the blade assembly 18 in the retracted position and the gap or recess 44*b* is used to lock the carriage in the extended position while the gap or recess 44*c* is used to lock the carriage in the conversion position. The selected gap or recess can be obtained by depressing the actuator button 38 to move inwardly towards the center of the channel 14 to cause the projections 36*h*, 36*i* to be moved out of a gap or recess. This frees the slide mechanism 36 to move along the axis. The actuator button 38 can then be released at any desired locking position by longitudinal or axial movements of the carriage 16 as well as the slide mechanism 36.

On the inside surface of the mating carriage member 16*b* (FIG. 5) there is provided a continuous recessed track or loop 48 that serves as another element of the bi-stable structure adapted to receive the track follower or pin 36*g* mounted on the arm 36*e*. Pin 36*g* and the track 48 together form a surface track follower structure that has a surface forming the continuous closed track 48 that captures the pin or track follower 36*g*.

Figure 6A:
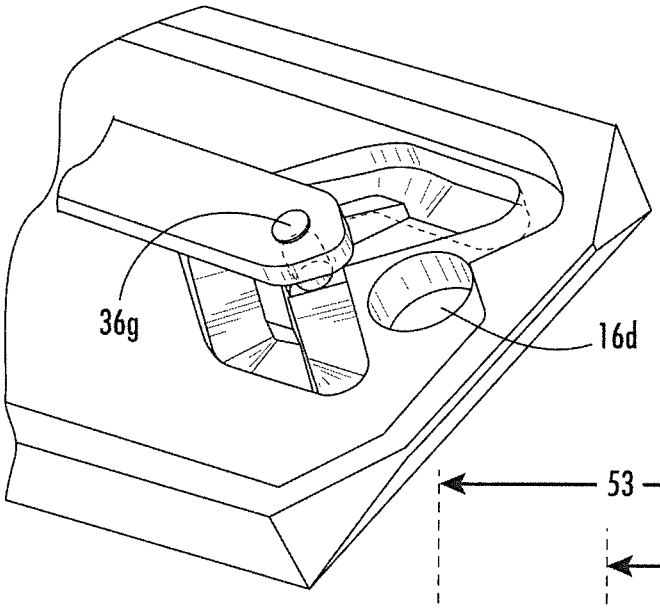
FIG. 6A is a partial fragmented view, in perspective, of the track follower mechanism coupled to the slide mechanism engaged to follow a track on the carriage.
Figure 6B:
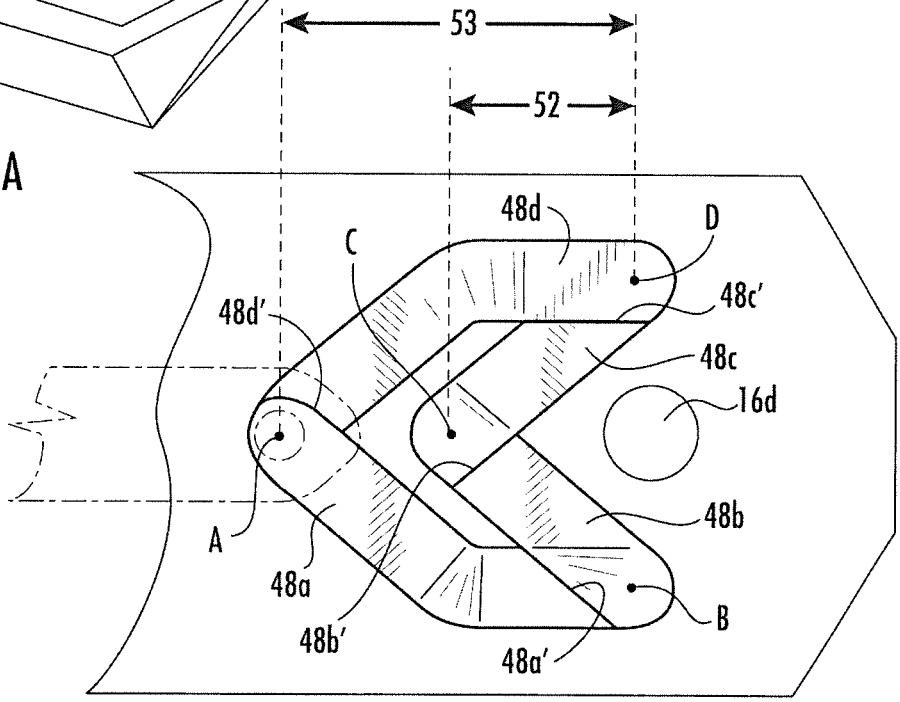
FIG. 6B is an enlarged top plan view of the track shown in FIG. 6A.
Figure 6C:
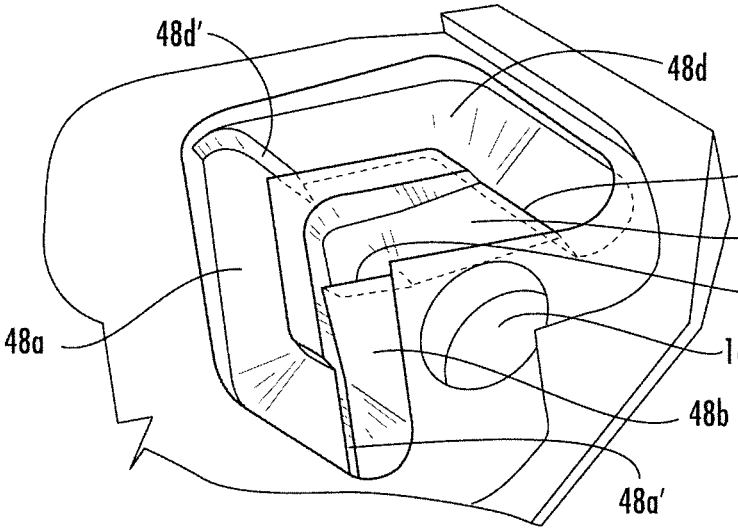
FIG. 6C is a perspective view of the track shown in FIGS. 6A and 6B to show the drops or discontinuities at the ends of each of the ramps in the track.
Figure 9:
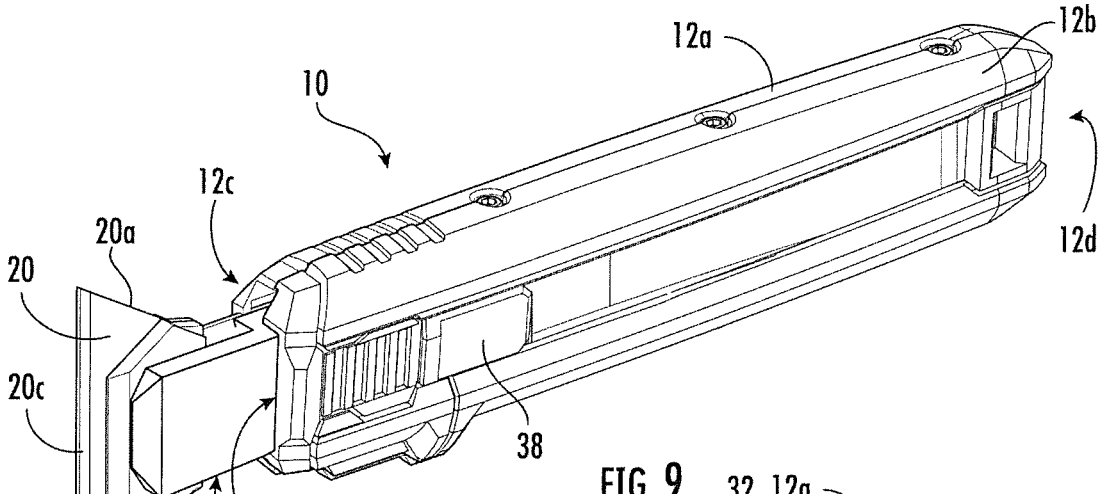
FIG. 9 is similar to FIG. 3 with the blade support assembly in a conversion position or region after the blade has been rotated or flipped to convert the tool from utility knife to scraper orientations and before the blade support assembly is moved inwardly to the operative scraper position shown in FIG. 3.
Figure 10:
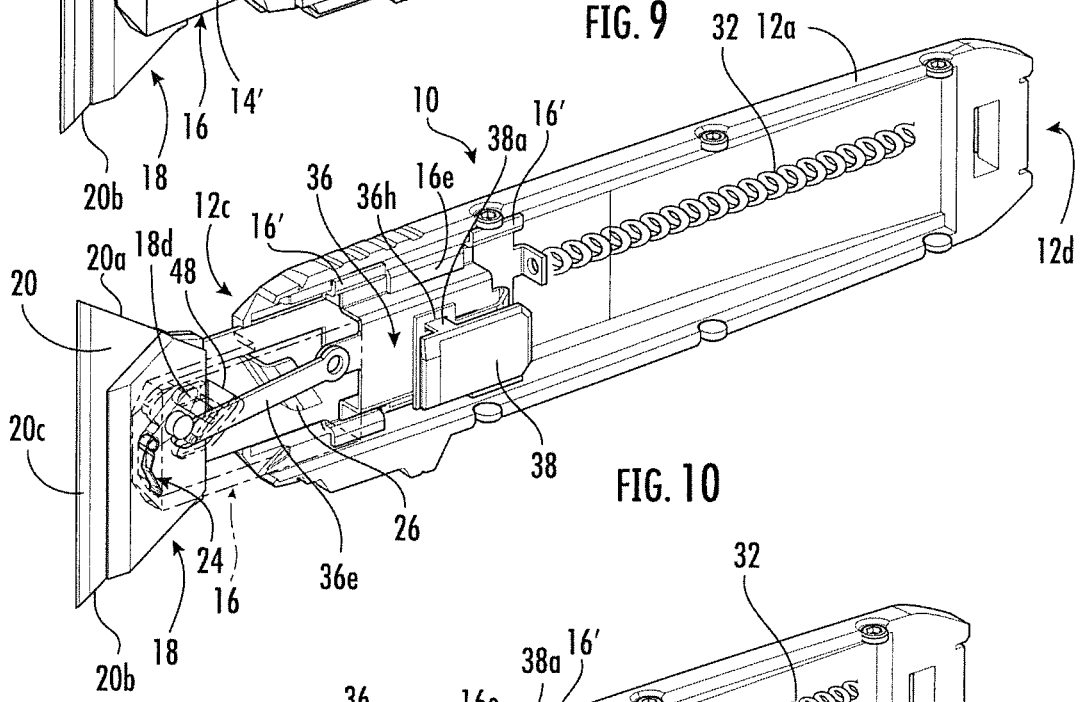
FIG. 10 is similar to FIG. 9 showing the components that rotate the blade support assembly as it is moved to the scraper orientation.
Figure 11:
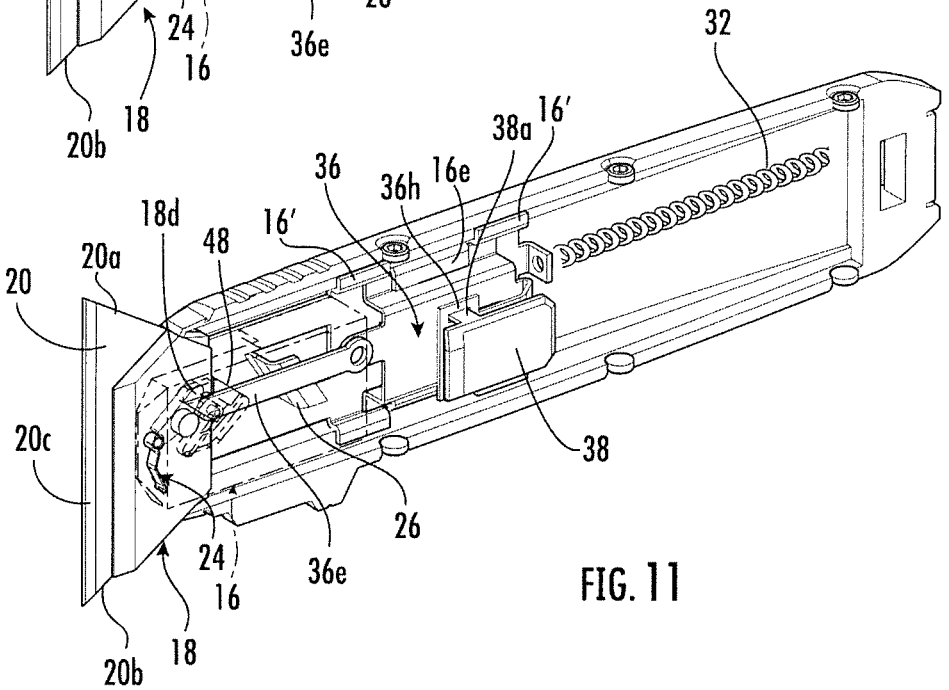
FIG. 11 is similar to FIG. 10 after the actuator button is released and the blade support assembly is retracted to bear against the housing during the scraper mode of operation.

Referring to FIGS. 6A-6C, the track 48 is a closed loop or track formed of a plurality of inclined ramps 48*a*-48*d* and arranged in the shape of a small "V" inset within a larger "V" or "U" as shown. At the end of each ramp there is provided a step or drop off 48*a*'-48*d*'. Referring specifically to FIG. 6B four rest locations at the beginning of each of the tracks or ramps are labeled A-D. As will be more fully described, position A represents the rest position of the blade support assembly 18 in the utility knife or cutting position of the blade. Position B is where the blade assembly is flipped or rotated to the scraper position. Position C represents the rest position of the blade support when in the scraper position of the blade. The position D is where the blade assembly is flipped or rotated in the reverse direction to the utility knife or cutting position of the blade, after which the surface follower mechanism reverts to position A. The axial distance between points D and C is 52 while the axial distance between points D and A is 53. The guide mechanism 36 and the compression spring 34 are arranged to insure incremental movements of the slide mechanism 36 at least equal to 53 once the carriage 16 can no longer move forward at the conversion position shown in FIGS. 9 and 10. As will be described in more detail, engagement between the track or groove 48 and the pin 36*g* of the slide mechanism 36 serve as a bi-stable structure for alternating pivoting the blade support 18 between two angular orientations by pivoting the blade support assembly between cutting and scraping positions when the actuator button 38 is successively advanced to move the slide mechanism beyond the position of the blade support within the conversion region.

The bi-stable structure, in the described embodiment, includes at least the slide mechanism 36 for moving the track follower pin 36*g* and the track or groove 48 and may include the compression spring 34. However, any bi-stable structure can be used that can pivot the blade support assembly between two angular positions by successive advancements of the actuator button 38.

Figure 4A:
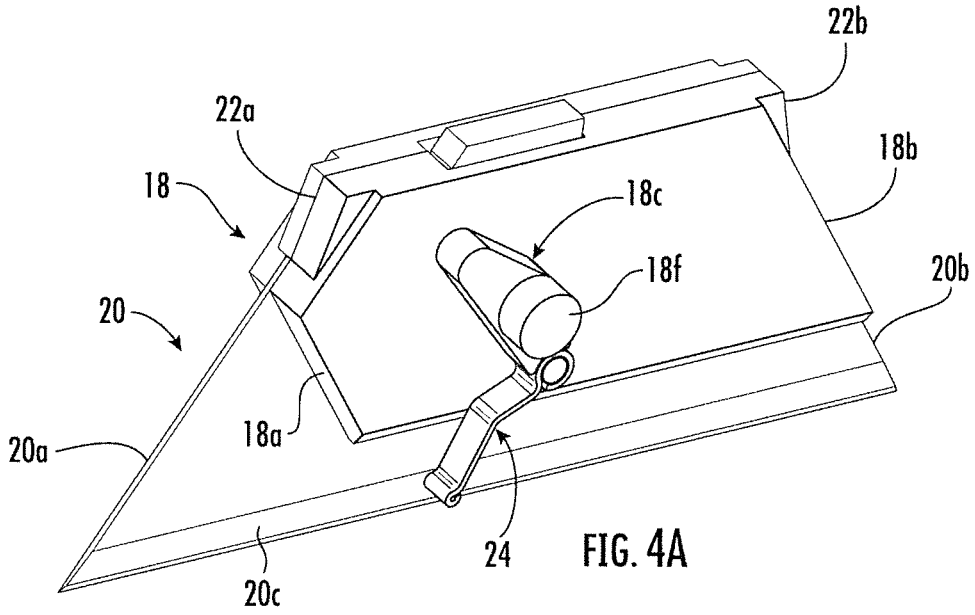
FIG. 4A is an enlarged perspective view of the blade carrier and blade and the actuator lever and the over-dead-center spring mounted thereon.
Figure 4B:
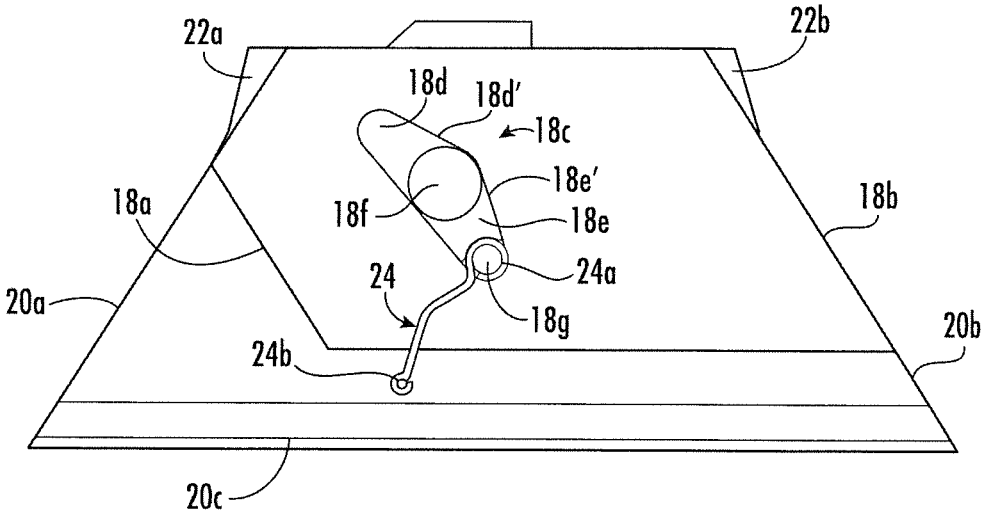
FIG. 4B is an elevational view of the blade carrier shown in FIG. 4A.

The actuator lever or cam 18*c* and the circular projection 18*f* shown in FIGS. 4A and 4B may be integrally formed with the blade support assembly or may be separate components that are fixedly attached to the blade support assembly by any suitable means.

The over-dead-center (ODC) spring 24 is provided with a loop at one end 24*a* that is loosely coupled around a cylindrical projection 18*g* at the free end of the lever or cam portion 18*e*. The other free end 24*b* of the spring 24 is arranged to be confined within a corner recess 16*g* (FIG. 5) of the mating carriage member 16*b* where the end 24*b* is held, retained or confined during the operation of the tool. As the actuator lever or cam 18*c* is rotated the spring 24 is flexed and when it passes a dead center condition of the spring 24 the spring snaps into a relaxed condition, propelling or aiding the actuator lever or cam 18*c* together with the blade support assembly 18 to move to the alternate position or orientation of the blade holder assembly 18. The spring 24, therefore, speeds up the transition of the blade holder assembly from one orientation to the other when the actuator button 38 is moved sufficiently forward to force the spring 24 to flex beyond its over-dead-center condition. While a spring 24 is disclosed for providing this action it should be clear to those skilled in the art that other ODC arrangements can be used that serve the same or similar functions, with different degrees of advantage. The springs 32 and 34 are preferred but optional and the tool can be operated and used without such springs in which case the axial movements are manually applied.

While FIG. 5 shows strips 42*a*-42*d* forming 3 gaps or recesses 44*a*-44*c* for receiving the tabs or projections 36*h* for locking the slide mechanism 36 and carriage 16 in three fixed positions. It should be clear that additional strips forming additional gaps may be provided along the longitudinal length of the housing to provide additional locking positions or stops to the carriage and, therefore, for the blade support assembly 18. For example, instead of fully extending the blade as shown in FIG. 2 it may be desired to partially extend the blade so that only a small portion or the tip of the cutting edge 20*a* is exposed. This is useful, for example, when cutting boxes or cartons while preventing damage to any contents therein.

Figure 7:
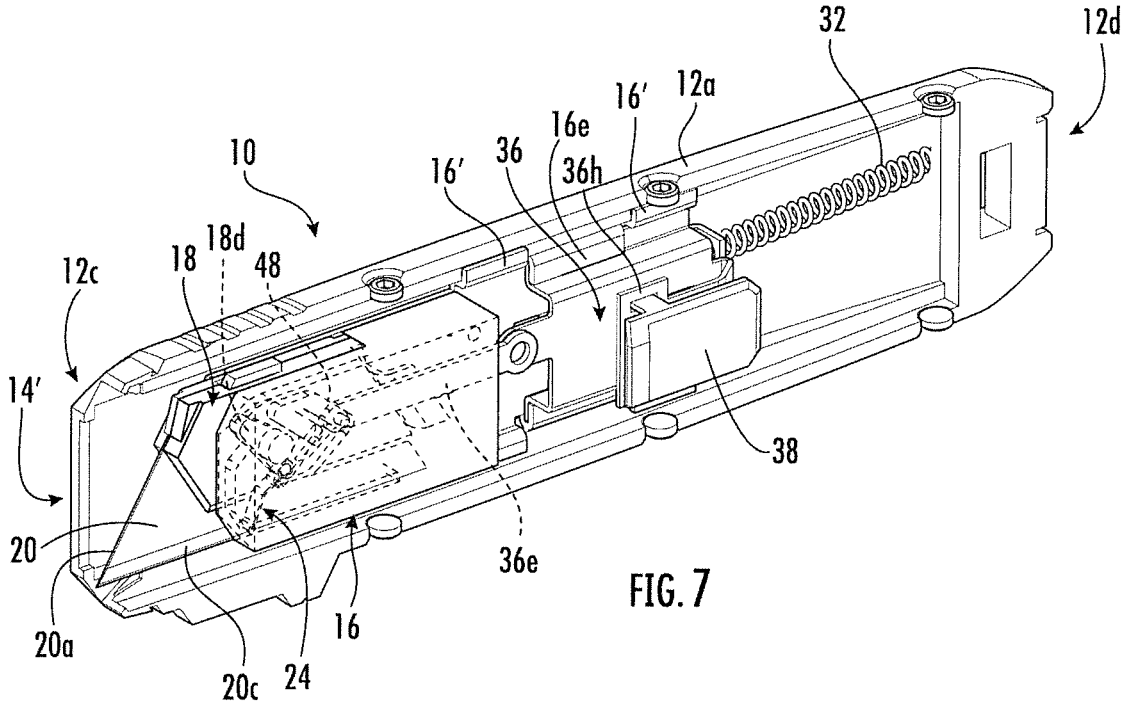
FIG. 7 is similar to FIG. 1, shown with one of the clamshells of the housing removed to expose the blade support assembly and the blade in a fully retracted position.

The operation of the tool will now be described. Referring to FIG. 7, the fully retracted position of the blade support assembly 18 is shown where the actuator button 38 is in its rear-most position. The tabs portions 36*h* and 36*i* are within the gaps or recesses 44*a* (FIG. 5). Pin or track follower 36*g* is, at this time, positioned at point A of the track 48 (FIG. 6B). When it is desired to extend the blade 20 for use in utility knife or cutting mode, the actuator button 38 is pressed inwardly, deflecting the spring finger 36*c* thereby moving the projections 36*h*, 36*i* from the recess or gap 44*a*. This frees the carriage 16 and the sliding mechanism 36 to move forwardly towards the front end 12*c* of the housing. When the tabs or projections 36*h*, 36*i* are aligned with gap or recess 44*b*, release of the actuator button 38 allows the projections to be received therein thereby locking the carriage 16 and slide mechanism 36 from additional longitudinal or axial movements. At this position, the blade support assembly 18 is in the position shown in FIGS. 2 and 8. The pin or track follower 36*g* is still positioned at point A of the track (FIG. 6B). If it is desired to convert the tool from a utility knife to a scrapper the actuator button 38 is again depressed, thereby enabling further forward motion of the carriage and blade support assembly. The projections or tabs 36*h* and 36*i* are moved to be locked in gaps or recesses 44*c* placing the blade support assembly in a conversion position shown in FIG. 10. The blade support assembly 18 has now moved to an outermost position where the blade support assembly 18 can rotate while clearing the housing 12 and flip from one orientation to another. To effect a conversion from knife to scraper modes the actuator button 38 is pressed inwardly and forwardly. In the conversion position the carriage 16 can no longer move forward having moved to its forward most position in the channel 14. The slide mechanism 36, however, can be advanced incrementally against the action of the compression spring 34 that seeks to revert the slide mechanism to normally aligned positions of the carriage 16 and the slide mechanism 36.

Figure 8:
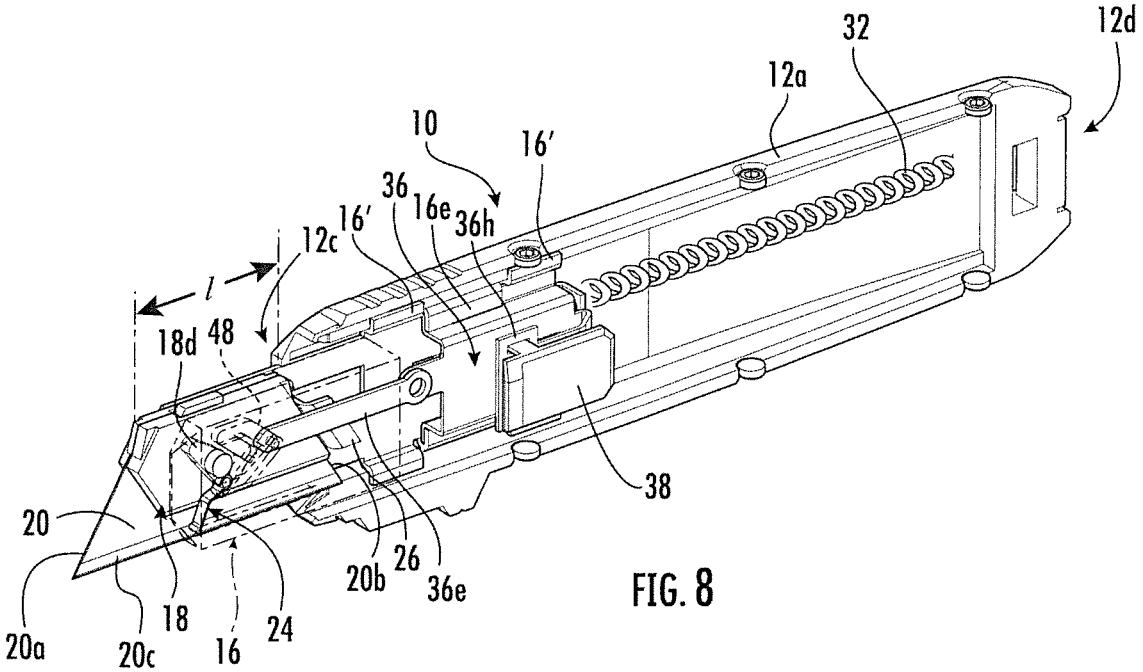
FIG. 8 is similar to FIG. 7 to show the positions of the component parts when the blade assembly is moved to an extended position for operative function as a utility knife as shown in FIG. 2.
Figure 13:
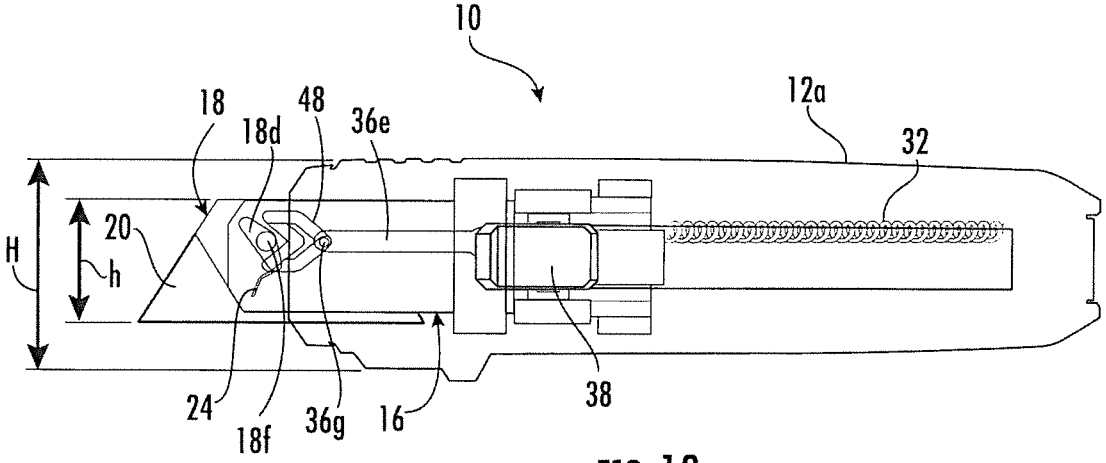
FIG. 13 is similar to FIG. 12 showing when the blade is in the extended or utility blade position shown in FIG. 2.
Figure 14:
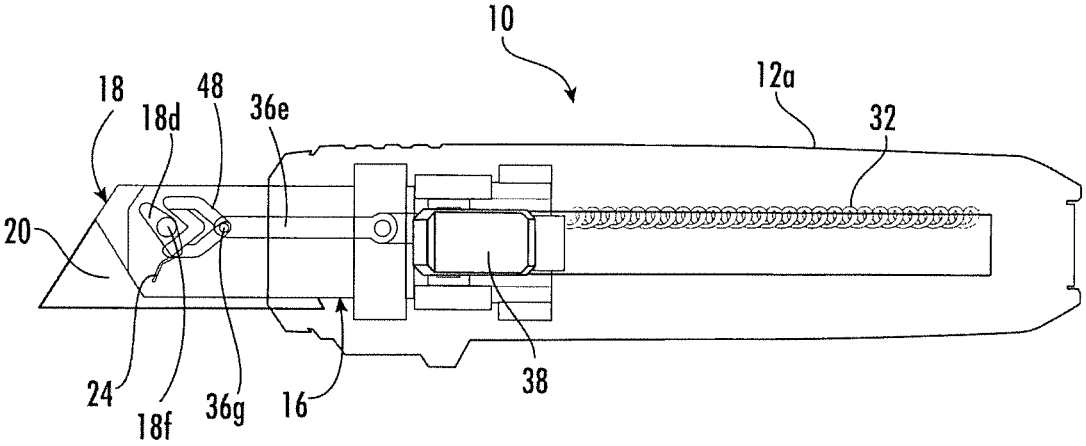
FIG. 14 is similar to FIG. 13 when the blade support assembly is moved outwardly beyond the extended position to a conversion position to clear the housing when rotating between operative orientations.
Figure 15:
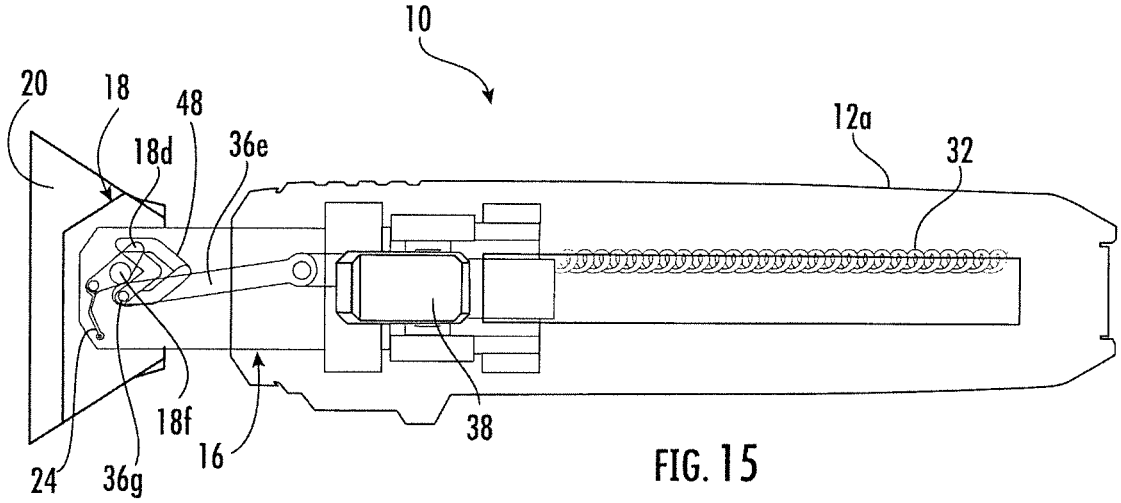
FIG. 15 is similar to FIG. 14 but is showing the blade assembly rotated or flipped to the scraper position or orientation before the assembly is moved rearwardly to abut against the housing.
Figure 16:
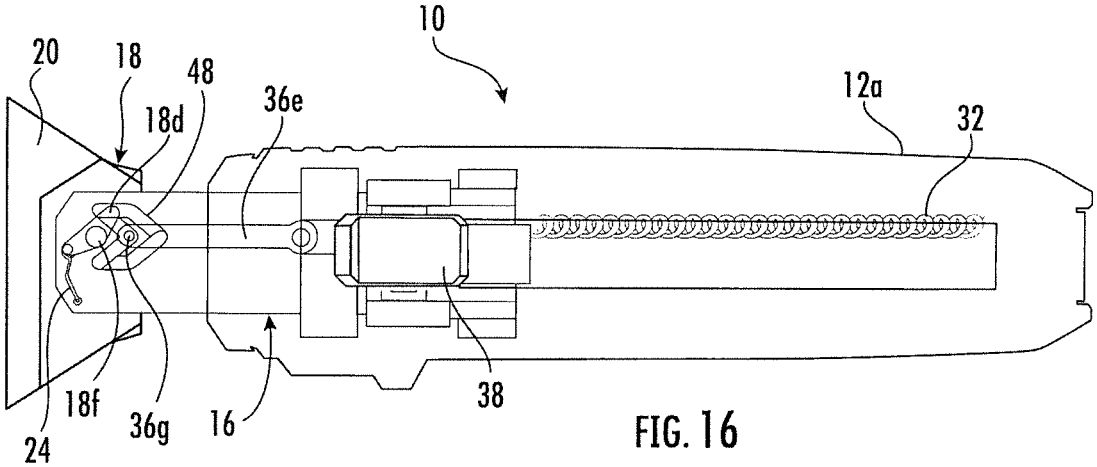
FIG. 16 is similar to FIG. 15 where the track follower is positioned to maintain the blade in the scraper position.
Figure 17:
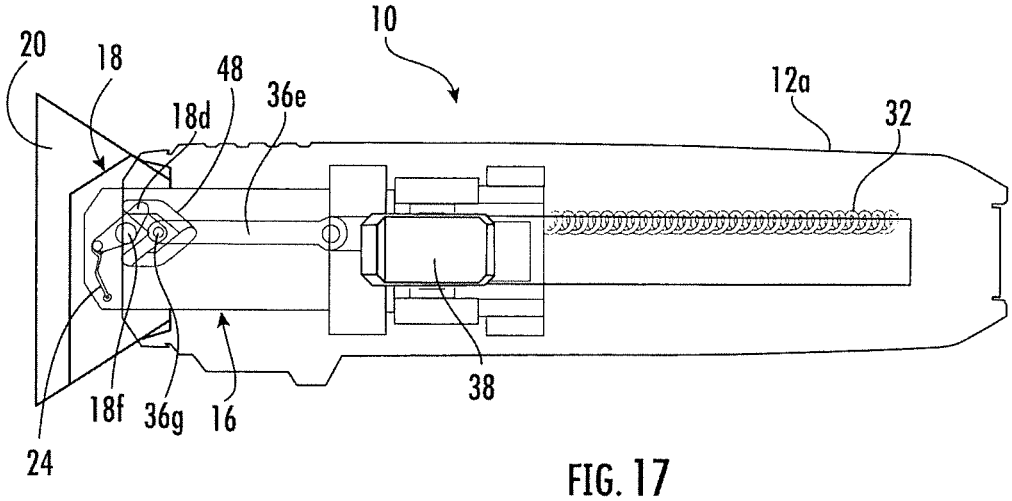
FIG. 17 is similar to FIG. 16 after the blade assembly is drawn into contact with the housing to enable the scraper function as shown in FIG. 3.
Figure 18:
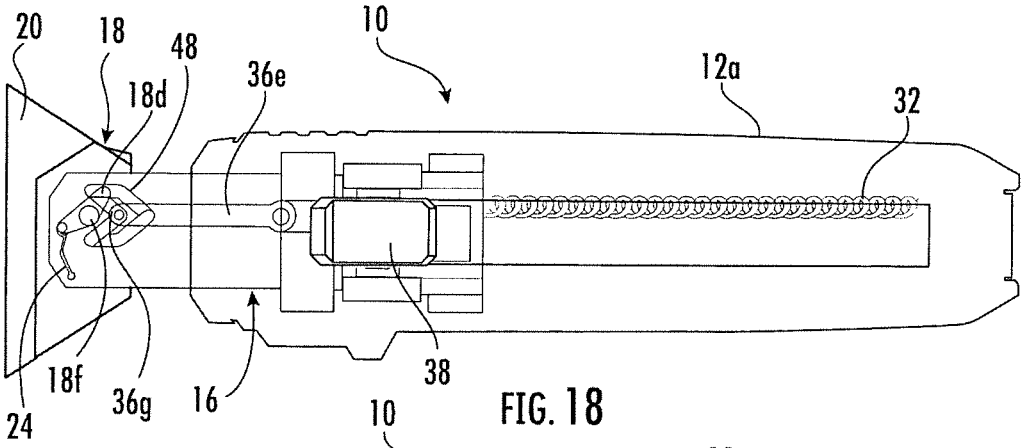
FIG. 18 illustrates advancement of the blade assembly to the conversion position just prior to rotating or flipping the blade assembly to the blade cutting orientation.

Relative advancement of the sliding mechanism 36 to the now stationary carriage 16 causes the pin or track follower 36*g* to move forwardly and downwardly (as viewed in FIGS. 9B and 10) from point A and follows the ramp 48*a* distance 53 to point B. The pin or track follower 36*g* cannot move along the upper path 48*d*, as shown in FIG. 7B, because of the step 48*d*' at the end of the ramp 48*d*. When the pin 36*g* reaches point B the free end of the arm 36*e* engages the lower part 18*e* of the actuator lever 18*c* and applies a force on the surface 18*e*' causing the actuator lever 18*c* to rotate in a clockwise direction, as viewed in FIG. 10, which causes the entire blade support assembly 18 to rotate in a clockwise direction to orient the blade in a scraper position or orientation. Release of the actuator button 38 at this point causes the sliding mechanism 36 to incrementally move rearwardly a distance 52 pulling with it arm 36*e* and the pin or follower 36*g*, bringing the pin 36*g* to position C in FIG. 6B. The pin 36*g* must follow the path along track portion 48*b* without being able to return along the ramp 48*a* due to the discontinuity 48*a*'. When the actuator button 38 is released the spring 32 causes the entire blade assembly to move rearwardly to bring the protuberences 22*a*, 22*b* on the blade support assembly 18 into abutment with the upper and lower bearing surfaces 12*e*, 12*f*, on both sides of the opening 14'. This is ensured by making the dimension "1" as shown in FIG. 8 to be somewhat greater than the height "h" of the slot or opening 14' (FIG. 13). In FIG. 13, the height "h" of the blade assembly 18 allows it to extend through the slot in the utility knife mode or position as shown. Further, the distance "l" is selected to be a distance that ensures full mating contact with the housing or handle 12 by making "1" greater than h and preferably closer to "H" which is the height of the overall housing.

Figure 12:
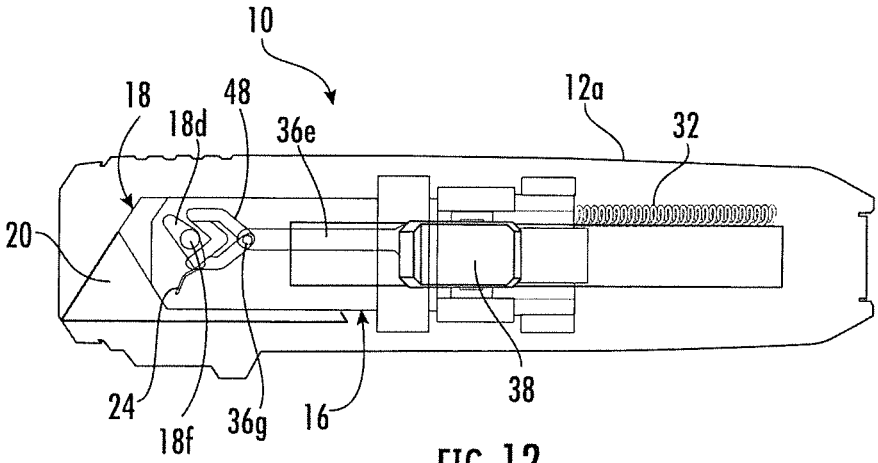
FIG. 12 is a side elevational view of the tool show in FIG. 1, showing the relative positions of the component parts when the blade is in the fully retracted position.
Figure 19:
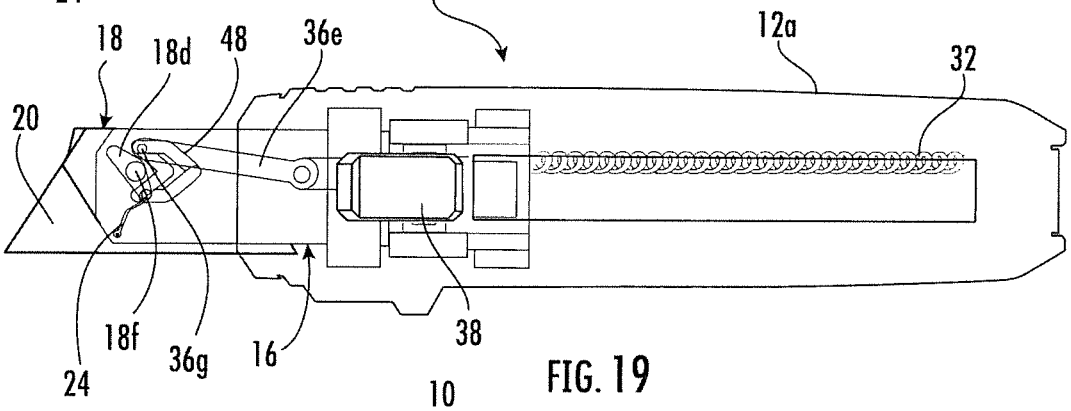
FIG. 19 is similar to FIG. 18 after the blade assembly has been rotated to orient the blade in the cutting or utility blade position.
Figure 20:
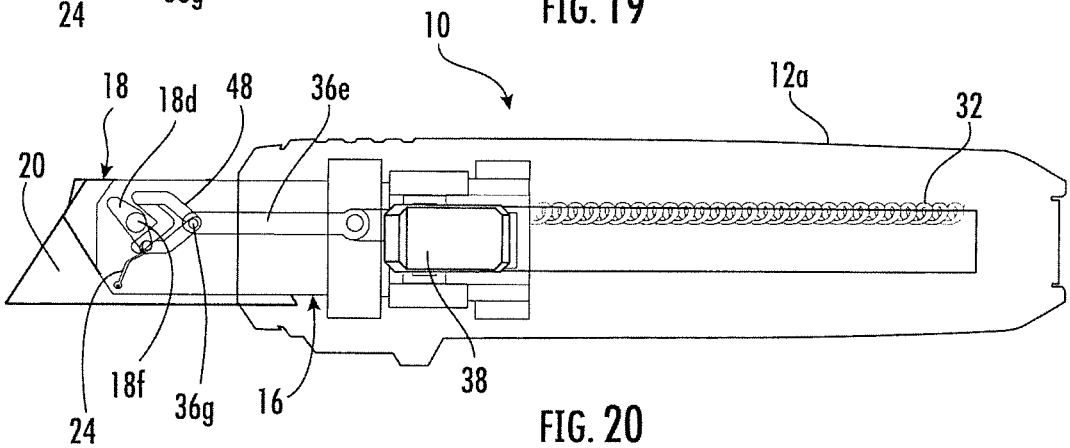
FIG. 20 is similar to FIG. 19 after the blade assembly has been moved to the extended position to provide the utility function of the tool.
Figure 21:
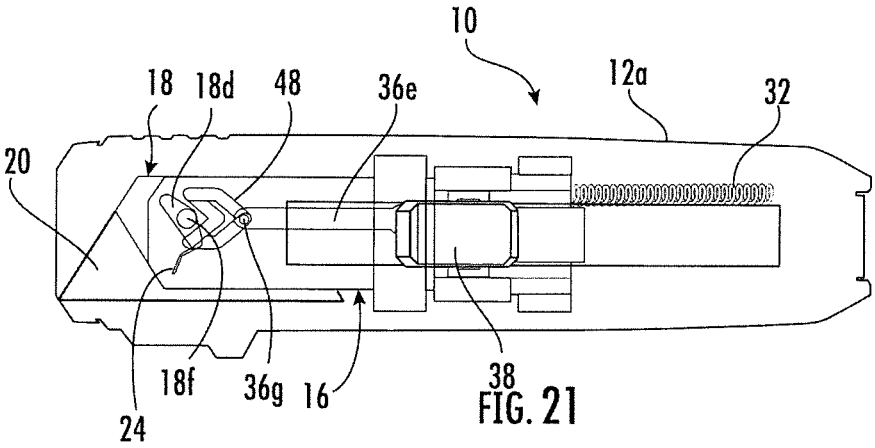
FIG. 21 is similar to FIG. 20 after the actuator button is moved to the retracted positions of the blade support assembly.
Figure 22:
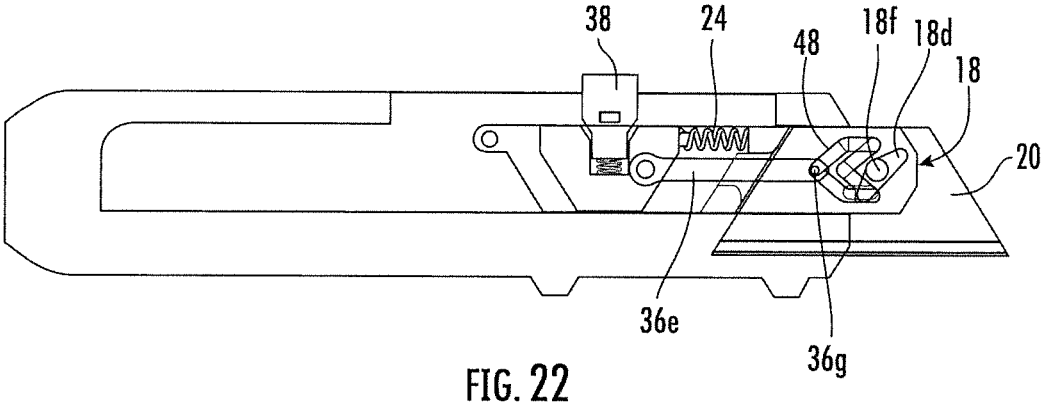
FIG. 22 shows another embodiment of the tool in which the actuator button is located at the top of the tool housing and the carriage assembly is modified to accommodate the location of the actuator button.

With the pin 36*g* positioned at point C in FIG. 6B a further forward movement of the actuator button 38 again overcomes the compression force of the spring 34 again advancing the slide mechanism 36 forwardly in relation to the back plate 16*a*. The advancement of the arm 36*e* and the follower pin 36*g* causes the pin to now move up the ramp 48C and drop over the step or discontinuity at 48*c*' to point D. When the pin 36*g* is moved to position D the free end of the arm 36*e* applies a force on the surface 18*d*' of the portion 18*d* of the actuator lever or cam 18*c* causing the blade support assembly 18 to rotate or pivot in a counter-clockwise direction as viewed in FIG. 19 thereby reverting the blade to the utility knife position or mode. Once this transition has taken place release of the actuator button 38 allows the compression spring 34 to move the slide mechanism 36 incrementally rearwardly a distance 53 in relation to the carriage 16 thereby pulling back the pin 36*g*. This pin can now move up the ramp 48*d*, move beyond the discontinuity 48*d*' and becomes lodged again at position A in FIG. 6B. The blade is again in the position shown in FIG. 2. After use as a utility knife the actuator button 38 can again be pressed inwardly and pushed rearwardly to return the tool to the initial condition as shown in FIGS. 1 and 12.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed:

1. A single-action convertible tool comprising an elongate housing having a front end and rear end and an elongate internal channel defining a longitudinal axis and having an end opening at said front end and an elongate opening in a side wall of said elongate housing in communication with said channel and extending along a direction substantially parallel to said axis;

a carriage slidably mounted for movement along said axis within said internal channel between a fully retracted position within said channel and fully extended position at least partially projecting beyond said end opening, said carriage including a first element;

a slide mechanism within said channel coupled to said carriage for sharing movements with said carriage between said fully extended and retracted positions and being movable to a conversion position beyond said fully extended position of said carriage, said slide mechanism further includes a second element engaged with said first element;

a blade support assembly for securing a blade, said blade support assembly being pivotally mounted on said carriage for movements between two generally orthogonal orientations, a first cutting orientation and a second scraping orientation;

an actuator button accessible exteriorly of said housing and coupled to said slide mechanism through said elongate opening for sliding said carriage and said slide mechanism between said fully extended and retracted positions and for moving said slide mechanism to said conversion-position;

said engagement between said first element and said second element being arranged to alternating pivot said blade support assembly and any blade mounted thereon between said two orthogonal orientations when said actuator button is successively advanced forwardly to move said slide mechanism from said fully extended to said conversion positions.

2. A tool as defined in claim 1, wherein said blade support assembly is provided with a first mating surface and said housing is provided with a second mating surface proximate to said end opening that can be mated with said first mating surface when said blade support assembly is moved to said scraping orientation and said carriage and said slide mechanism are moved to said fully extended position, whereby forces acting on a blade during scraping are transmitted to said housing.

3. A tool as defined in claim 2, wherein said second mating surface comprises two abutment surfaces on said housing on opposite sides of said end opening, and said mating surface comprises two bearing surfaces spaced from each other on said blade support assembly to align with and contact said two abutment surfaces when said blade support assembly is moved to said scraping orientation and in an operative scraping position.

4. A tool as defined in claim 1, further comprising locking means within said housing for selectively locking the position of said carriage in at least said extended position.

5. A tool as defined in claim 4, wherein said locking means is arranged to selectively lock said carriage in said fully extended and fully retracted positions.

6. A tool as defined in claim 1, wherein in said cutting orientation a cutting edge of a blade supported by said blade support assembly is generally parallel to said axis and in said scraping orientation the cutting edge is generally normal to said axis.

7. A tool as defined in claim 1, further comprising biasing means acting between said carriage and said elongate housing for normally urging said carriage towards said rear end.

8. A tool as defined in claim 1, further comprising biasing means acting between said slide mechanism and said carriage for normally urging said slide mechanism to revert to said fully extended position from said conversion position of said slide mechanism relative to said carriage when said actuator button is released.

9. A tool as defined in claim 1, further comprising an over-dead-center spring on said blade support assembly arranged to engage said carriage and assist in said pivoting of said blade support assembly from one of said orientations to the other of said orientations when said slide mechanism is advanced from said fully extended position to said conversion position.

10. A tool as defined in claim 1, wherein said first element is a track or groove and said second element is a cam follower engaged in said track or groove.

11. A tool as defined in claim 10, wherein said track or groove is formed within said carriage and said cam follower is coupled to said slide mechanism captured within said track or groove.

12. A tool as defined in claim 11, wherein said cam follower includes an arm pivotably mounted at one end of said slide mechanism and a follower pin at another end of said arm dimensioned to be received within and follow said track or groove.

13. A tool as defined in claim 11, wherein said track or groove is continuous and comprises a plurality of successive ramps that gradually elevate said follower pin and drop said follower pin between said successive ramps to insure that said cam follower always advances in the same direction along said track or groove.

14. A tool as defined in claim 13, wherein said track or groove has two leading or forward positions spaced from each other in relation to said axis wherein movement of said follower pin to one of said two positions causes said blade support assembly to move from one to said other one of said two orthogonal orientations.

* * * * *